US006681498B2

(12) United States Patent
Steffan

(10) Patent No.: US 6,681,498 B2
(45) Date of Patent: Jan. 27, 2004

(54) BLAST NOZZLE

(75) Inventor: Werner Steffan, Eichenbühl (DE)

(73) Assignee: Novartis AG, Basel (CH)

( * ) Notice: Subject to any disclaimer, the term of this patent is extended or adjusted under 35 U.S.C. 154(b) by 0 days.

(21) Appl. No.: 10/115,401

(22) Filed: Apr. 3, 2002

(65) Prior Publication Data

US 2002/0178606 A1 Dec. 5, 2002

(51) Int. Cl.[7] ..... F26B 21/06

(52) U.S. Cl. ..... 34/84; 34/83; 34/107; 206/5.1

(58) Field of Search ..... 34/83, 84, 107, 34/241; 239/567, 590.5; 15/300.1, 405, 415.1; 206/5.1

(56) References Cited

U.S. PATENT DOCUMENTS

| | | | | | |
|---|---|---|---|---|---|
| 2,933,259 | A | * | 4/1960 | Raskin | 239/405 |
| 5,687,541 | A | * | 11/1997 | Martin et al. | 53/54 |
| 6,241,166 | B1 | * | 6/2001 | Overington et al. | 239/553.3 |
| 6,502,876 | B1 | * | 1/2003 | Stockhorst et al. | 294/64.1 |

* cited by examiner

*Primary Examiner*—Ira S. Lazarus
*Assistant Examiner*—Kathryn S. O'Malley
(74) *Attorney, Agent, or Firm*—Jian S. Zhou; R. Scott Meece; Robert J. Gorman

(57) ABSTRACT

The invention is concerned with the problem of ensuring optimum drying of contact lenses on a gripper, while at the same time minimizing interruptions in operations. This is achieved by a convex shape of the end face of the blast nozzle.

11 Claims, 1 Drawing Sheet

BLAST NOZZLE

Figure 1:
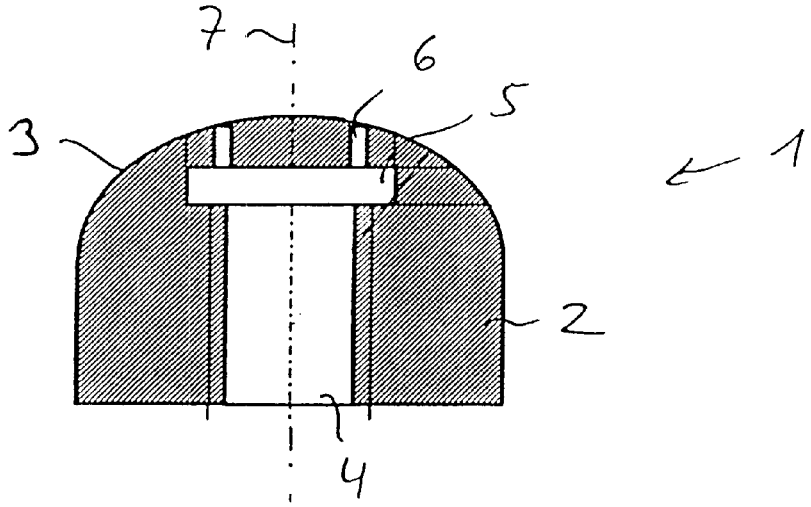

This application claims under 35 U.S.C. §119(a)–(d) or §365(b) of Germany Application No. 20106262.3 filed Apr. 10, 2001.

The invention relates to a blast nozzle, especially for drying contact lenses.

Contact lenses, which are to be manufactured economically in large unit numbers, are preferably manufactured by the so-called mould or full-mould process. In these processes, the lenses are manufactured into their final shape between two mould halves, so that there is no need to subsequently finish the surfaces of the lenses, nor to finish the edges. Mould processes are described for example in PCT patent application WO 87/04390 or in EP-A 0 367 513.

In these known mould processes, the geometry of the contact lens to be manufactured is defined by the mould cavity. The edge of the contact lens is likewise formed by the mould which normally consists of two mould halves. The geometry of the edge is defined by the contour of the two mould halves in the area in which they make contact. The contact lenses produced in this manner are moulded parts having little mechanical stability and a water content of more than 60% by weight. After manufacture, the lens is checked using measuring techniques, then packaged and subjected to heat sterilisation at 121° C. in an autoclave.

To manufacture a contact lens, first of all a certain amount of the flowable starting material is placed in the female mould half. Afterwards, the mould is closed by placing the male mould half thereon. Normally, a surplus of starting material is used, so that, when the mould is closed, the excess is expelled into an overflow area adjacent to the outer mould cavity. The subsequent polymerisation or crosslinking of the starting material takes place by radiation with UV light, or by heat action, or by another non-thermal method.

Subsequently, the contact lenses thus produced must be removed from the mould halves, preferably from the female mould halves. To do this, a gripper is provided for example, which is moved in the direction of the mould half and removes the lenses from the mould half by applying suction to the lenses with a vacuum. After removing the lenses, the gripper arm moves into another position, so that further procedures can be carried out, such as drying of the contact lenses on the gripper, checking of the contact lens using an image-processing system, placing the contact lenses in a package, and rinsing and drying of the gripper itself. To this end, the gripper may be, for example, star-shaped, and in this configuration represents the connecting link between manufacturing the contact lenses and primary packaging. Only the lenses that are centred by the gripper and grasped smoothly can be checked by the image-processing system and subsequently deposited in the package. In addition to perfect removal of the lenses by the gripper, another essential prerequisite to attaining a high yield of the equipment is satisfactory presentation of the lens for the image processing process.

Usually prior to removal from the mould half, the contact lenses are first of all loosened and, if desired, also transferred from the male to the female mould half, since the actual removal of the contact lenses is preferably effected from the female mould half. To enable the apparatus to be operated most economically, several mould halves, preferably a figure of 10, can be held in one tool and grasped together by one gripper arm, which accordingly has 10 grippers.

An essential condition for providing good presentation of the contact lens for image processing is a lens that is as dry as possible, especially in the periphery. In a lens, defects such as bubbles and tears may occur as a result of the production process. However, if for example some drops are found on the lens due to the loosening procedure, the image processing system cannot distinguish between these artefacts and the actual defects, so that lenses which have no defects are also sorted as defective lenses. Therefore, the lenses on the gripper have to be dried by a drying nozzle. To dry the lenses, previously a nozzle of a concave shape was used. The shape was adapted to the design of the contact lens. Of course, during the drying process, interruptions always occurred. These were caused by lenses or lens residues falling from the gripper and by residues of the unpolymerised lens material.

The invention is concerned with the problem of ensuring optimum drying of the contact lenses on the gripper, whilst at the same time minimising interruptions in operations.

The invention solves this problem with the features indicated in claim 1. As far as further essential refinements are concerned, reference is made to the dependent claims.

Owing to the convex shape of the outer contour of the blast nozzle, defects on the edge of the lens in particular can be readily detected, since the drying process operates in optimum manner compared with a concave shape. In addition, a convex shape enables lenses or lens residues that drop down to slide along the nozzle and not to clog the nozzle jets any more.

Figure 2:
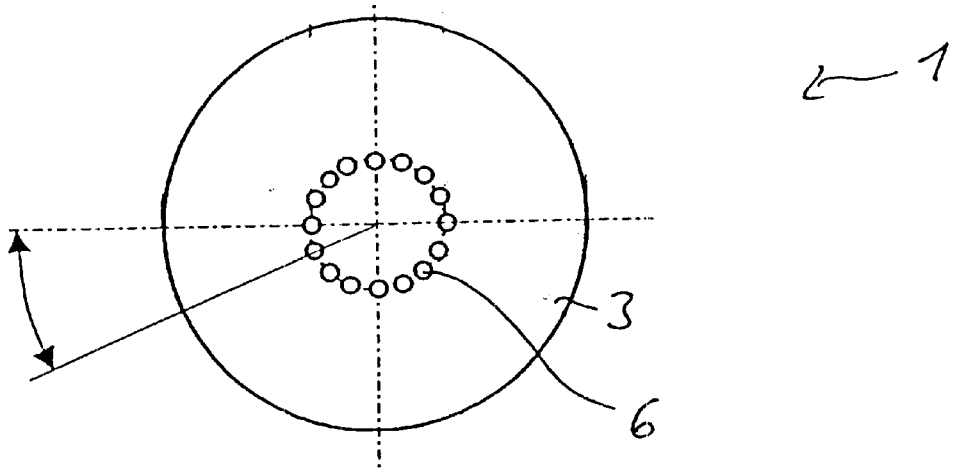

Further details and advantages of the invention may be seen from the description that follows and the drawing. In the drawing, FIG. 1 illustrates a section of a blast nozzle according to the invention;

FIG. 2 illustrates a plan view of the blast nozzle of FIG. 1.

A blast nozzle 1 illustrated in FIG. 1 is preferably made of one piece and consists of a cylindrical basic element 2, the end face 3 of which is of convex shape. The inside of the basic element 2 advantageously has a core bore 4, which preferably extends into the convex end region of the nozzle 1 and there it changes to a broadened hollow cavity 5. This core bore 4 serves to connect with a supply of compressed air. As is evident from FIG. 2, the blast nozzle 1 has jets 6 on its end face 3. These are conveniently arranged in a circular configuration in order to enable drying of the contact lens to be as uniform as possible. In the embodiment illustrated in FIG. 2, a total of 16 jets are provided. However, it is conceivable for another number or arrangement of jets 6 to be selected. As is evident from FIG. 1, the jets 6 are parallel to the main axis 7 of the nozzle 1, but it is also possible for the jets 6 to be placed at a certain angle to the main axis 7 of the blast nozzle 1, if it is desired that the compressed air flows in another direction. The jets 6 open into the hollow cavity 5 and are supplied with compressed air from there.

It has been shown that, owing to the convex shape of the blast nozzle, it is possible for drying of the contact lenses to be uniform, whilst at the same time avoiding interruptions to the operation caused by lenses and lens residues dropping from the gripper, since they slide along the end face of the nozzle and no longer clog the nozzle jets. Furthermore, this embodiment simplifies the assembly of the blast nozzle, since it is no longer necessary to align the convex blast nozzle with high precision towards the conical end face of the gripper.

What is claimed is:

1. A blast nozzle for drying contact lenses, comprising:

cylindrical basic element with a convex end face, and jets for blowing compressed air onto the a contact lens to dry the contact lens, wherein the jets are arranged on the convex end surface and can be linked to a supply of compressed air.

2. A blast nozzle according to claim 1, wherein the inside of the cylindrical base has a core bore having a diameter larger than the diameter of the jets.

3. A blast nozzle according to claim 2, wherein the jets are arranged in a circular configuration on the convex end face, open into a hollow cavity near the convex end surface, wherein the core bore extends into the hollow cavity and has a diameter smaller than the hollow cavity.

4. A blast nozzle according to claim 3, wherein the axis of the jets runs parallel to the axis of the basic element.

5. A blast nozzle according to claim 1, wherein the jets are arranged in a circular configuration on the convex end face.

6. A blast nozzle according to claim 5, wherein the axis of the jets runs parallel to the axis of the basic element.

7. A blast nozzle according to claim 1, wherein the axis of the jets runs parallel to the axis of the basic element.

8. A blast nozzle, comprising:

a cylindrical basic element having a convex end face, a hollow cavity near the convex end surface and a core bore extending into the hollow cavity, wherein the hollow cavity has a diameter larger than the core bore, wherein the core bore is linked to a supply of compressed air; and jets being arranged on the convex end surface for blowing the compressed air onto a contact lens to dry the contact lens, wherein the jets open into the hollow cavity and are supplied with the compressed air from there.

9. The blast nozzle of claim 8, wherein the jets are arranged in a circular configuration on the end face.

10. The blast nozzle of claim 9, wherein the axis of the jets runs parallel to the axis of the basic element.

11. The blast nozzle of claim 8, wherein the axis of the jets runs at to the axis of the basic element.

* * * * *